US008894004B1

(12) United States Patent
Scott et al.

(10) Patent No.: US 8,894,004 B1
(45) Date of Patent: Nov. 25, 2014

(54) FOLDING ARTICULATING WING MECHANISM

(71) Applicant: The United States of America as Represented by the Secretary of the Navy, Washington, DC (US)

(72) Inventors: Aaron Michael Scott, Ridgecrest, CA (US); Philip Thomas Aberer, Ridgecrest, CA (US); Neil Randall Japp, Ridgecrest, CA (US); Nicholas Cody McGaha, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 60 days.

(21) Appl. No.: 13/915,318

(22) Filed: Jun. 11, 2013

(51) Int. Cl.
*B64C 3/56* (2006.01)

(52) U.S. Cl.
CPC ..... *B64C 3/56* (2013.01)
USPC ..... 244/49; 244/3.27; 244/3.28; 244/3.29

(58) Field of Classification Search
USPC ..... 244/49, 3.27, 3.28, 3.29, 123.1, 131
See application file for complete search history.

(56) References Cited

U.S. PATENT DOCUMENTS

| | | | | |
|---|---|---|---|---|
| 5,192,037 | A * | 3/1993 | Moorefield | 244/46 |
| 5,820,072 | A * | 10/1998 | Na et al. | 244/49 |
| 6,224,013 | B1 * | 5/2001 | Chisolm | 244/3.27 |
| 7,732,741 | B1 * | 6/2010 | Whitham | 244/3.27 |
| 8,157,206 | B2 * | 4/2012 | Gionta et al. | 244/49 |

* cited by examiner

*Primary Examiner* — J. Woodrow Elred
(74) *Attorney, Agent, or Firm* — Christopher L. Blackburn

(57) ABSTRACT

Obliquely folding articulating wing mechanisms that include a wing rotatingly connected to a base.

10 Claims, 12 Drawing Sheets

FOLDING ARTICULATING WING MECHANISM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to deployable wing mechanisms.

It is to be understood that the foregoing general description and the following detailed description are exemplary and explanatory only and are not to be viewed as being restrictive of the invention, as claimed. Further advantages of this invention will be apparent after a review of the following detailed description, of the disclosed embodiments, which are illustrated schematically in the accompanying drawings and in the appended claims.

DETAILED DESCRIPTION OF EMBODIMENTS OF THE INVENTION

Figures 1, 2:
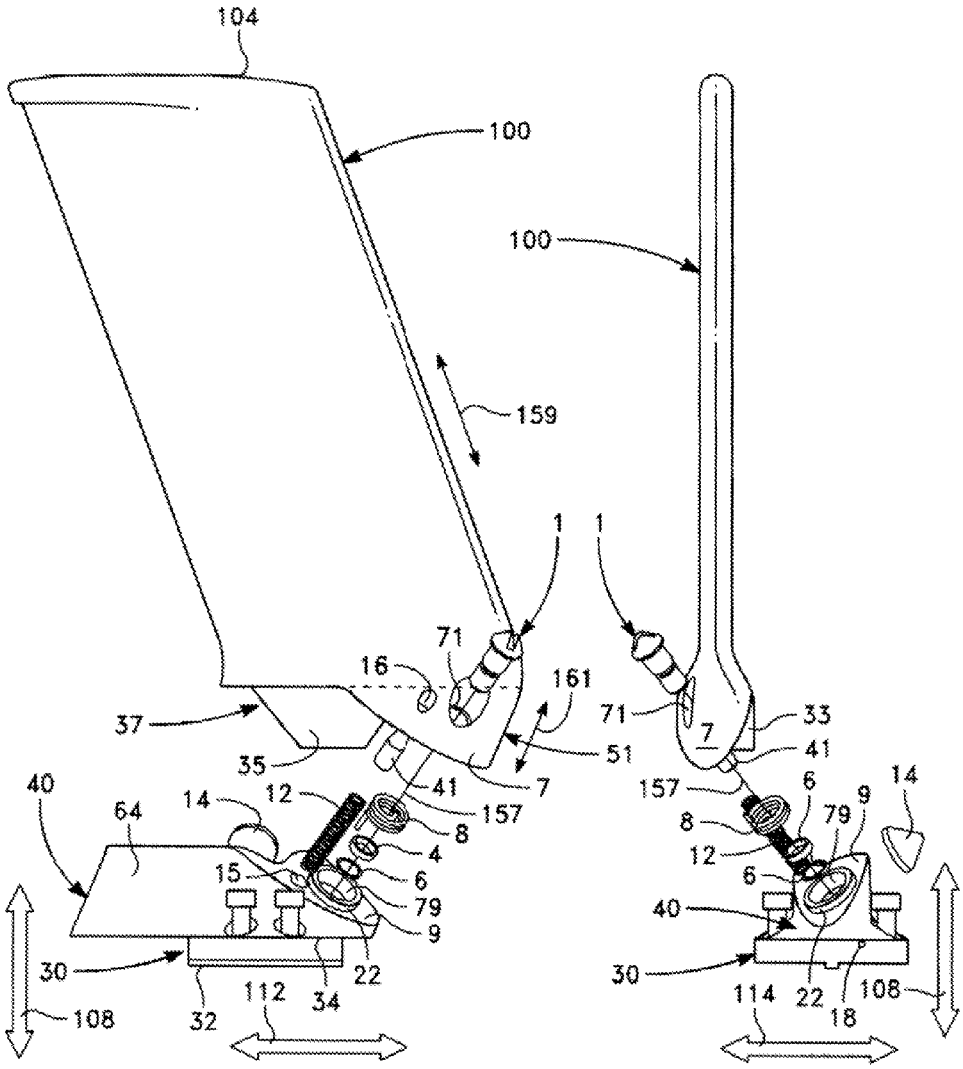
FIG. 1 is a side assembly view of an unassembled embodiment of a wing mechanism in a fully deployed position.
FIG. 2 is a front assembly view of an unassembled embodiment of a wing mechanism in a fully deployed position.
Figure 3:
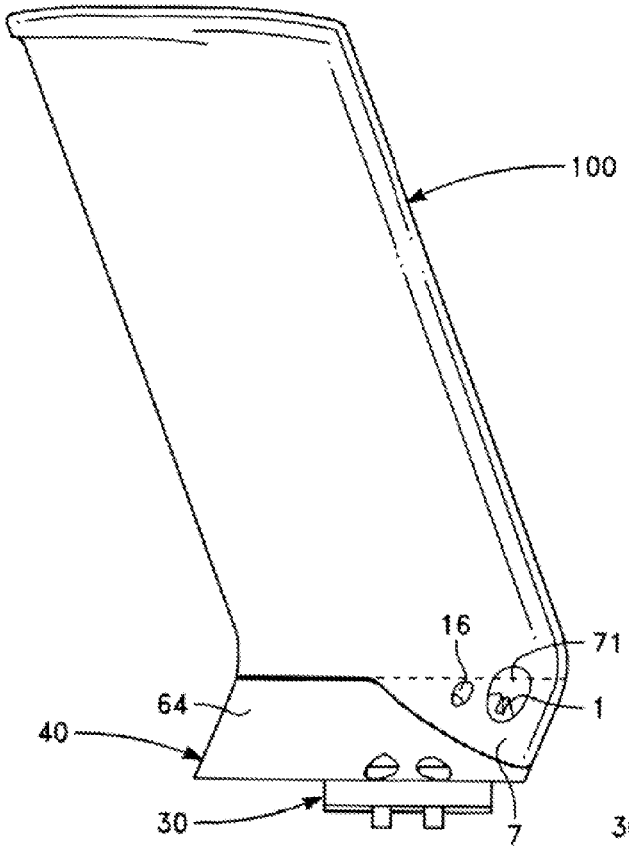
FIG. 3 is a side view (from same side as FIG. 1) of an assembled embodiment of a wing mechanism in a fully deployed position.
Figure 4:
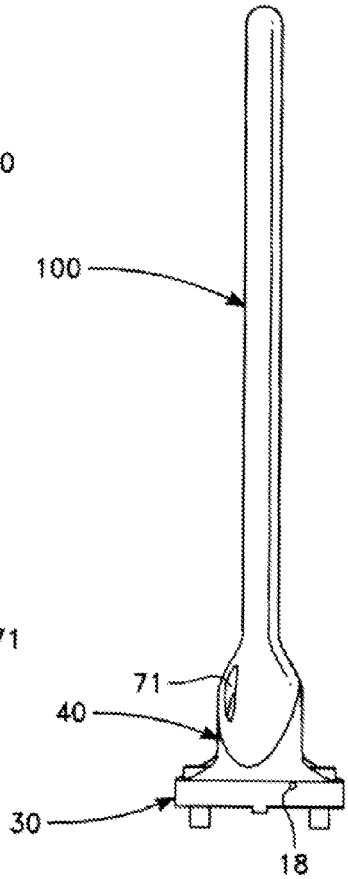
FIG. 4 is a front assembly view of an assembled embodiment of a wing mechanism.
Figure 19A:
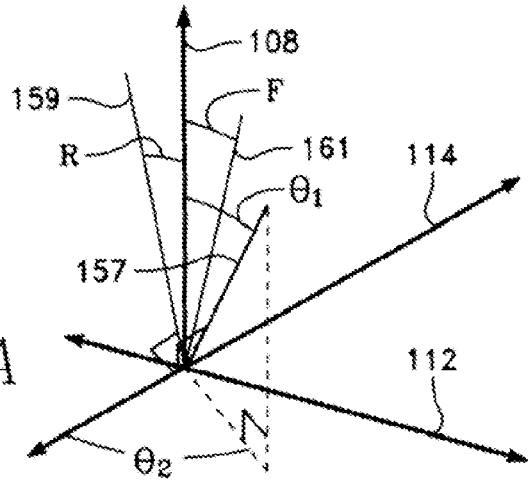
FIG. 19A illustrates various angles and directions (not to scale) of a fully deployed wing using a three-dimensional coordinate system using directions defined in FIGS. 1 and 2 as axes.
Figure 19B:
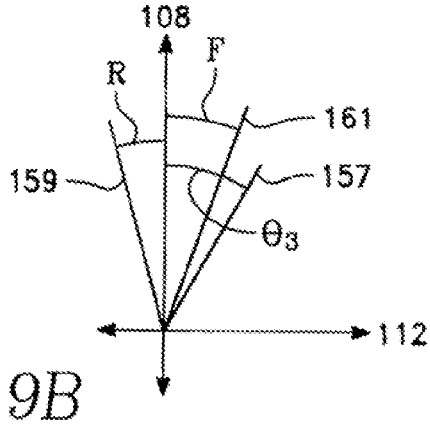
FIG. 19B illustrates various angles and directions (not to scale) of a fully deployed wing using a two-dimensional coordinate system using directions defined in FIG. 1 as axes.
Figure 19C:
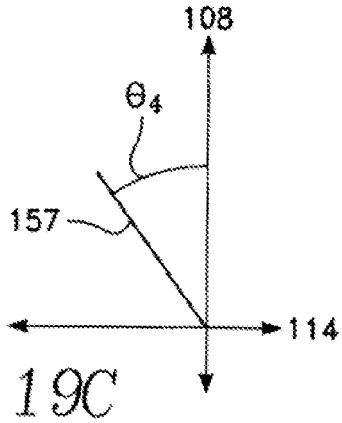
FIG. 19C illustrates various angles and directions (not to scale) of a fully deployed wing using a two-dimensional coordinate system using directions defined in FIG. 2 as axes.
Figure 20:
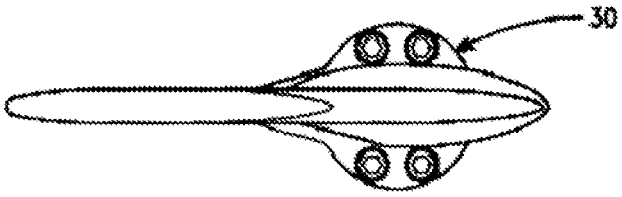
FIG. 20 is an overhead view of an assembled wing mechanism in a fully deployed position.

Like reference numbers indicate like parts, apertures/channels, features, angles and/or directions as will be clear from the context. Note that dashed lines in FIGS. 1, 3, 5, and 21 are included to visually delineate some surfaces. For example, the dashed line in FIG. 1 delineates an upper bound of the visible side of wing root 7. Also for example, the dashed line in FIG. 5 delineates the upper bound of the visible side of tab 37. FIGS. 1 and 2 illustrate directions referred to herein as follows: 1) 112 in FIG. 1 illustrates longitudinal directions of the airframe body, wherein direction along 112 from left to right in FIG. 1 is referred to herein as the "forward direction";

2) 114 in FIG. 2 illustrates cross-sectional directions of the airframe body wherein a direction along 114 from right to left in FIG. 2 is referred to as the "side direction"; 3) 108 in FIGS. 1 and 2 defines what is referred to herein as the "vertical direction", which is transverse to both 112 and 114; and 4) 157 in FIGS. 1 and 2 illustrates a rotational axis about which the wing rotates during deployment. With reference to FIG. 1, wing 100 has a rearward sweep, the direction of which, when the wing is fully deployed, is described by direction arrow 159. Wing 100 has a forward sweep on the forward edge 51 of wing root, the direction of which, when the wing is fully deployed, is described by direction arrow 161. FIG. 19A illustrates various angles and directions of a fully deployed wing using a three-dimensional coordinate system using directions 112, 114, and 108 as axes. FIG. 19B illustrates various angles and directions of a fully deployed wing using a two-dimensional coordinate system using 112 as the horizontal axis and 108 as the vertical axis. FIG. 19C illustrates various angles and directions of a fully deployed wing using a two-dimensional coordinate system using 114 as the horizontal axis and 108 as the vertical axis.

With reference to FIGS. 1-18 and 21-25C, a folding and locking wing mechanism includes a base 40 (which optionally includes an integrally formed cylindrical mounting hub 30) and wing 100. Base 40 and wing 100 are formed of an essentially rigid, impact-resistant and corrosion-resistant material such as stainless steel, aluminum, a metal alloy, a composite material, or the like, having sufficient strength and rigidity to be used in this application. With reference to FIG. 1, wing 100 has a distal end 104.

Where included, mounting hub 30 is integrally formed with base 40. With reference to FIG. 1, mounting hub 30 has a first end portion 32 and a second end portion 34 at which base 40 is integrally formed. First end portion 32 of mounting hub 30 is adapted to operatively engage either the airframe body or an actuator of a vehicle flight control system located on the object to which the wing mechanism is or will be attached. At least one fastener 1 secures (in some embodiments, removably) base 40 to the airframe body or controlled actuator mechanism; the fastener can be any fastener, such as, for example, a screw, retaining clip, or retaining ring.

Figure 21:
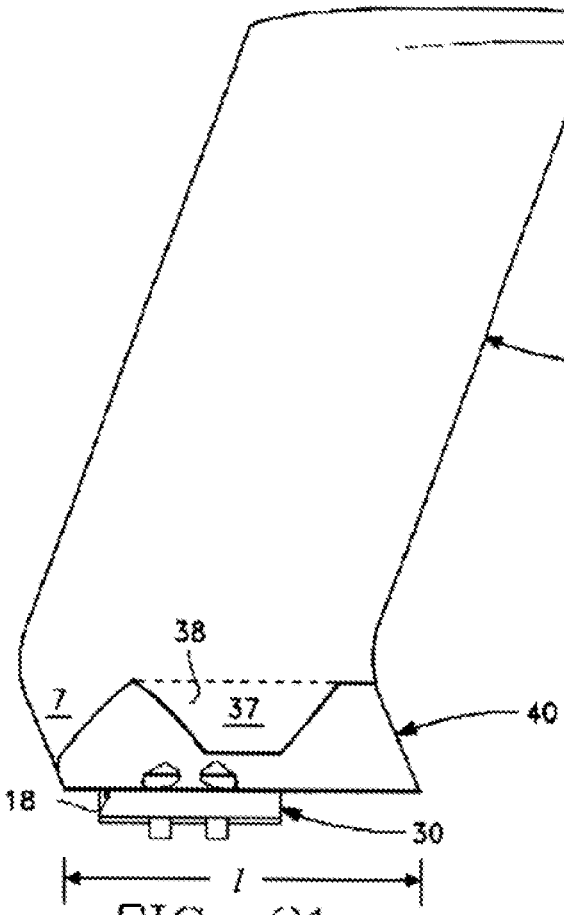
FIG. 21 is a side view (from same side as FIG. 5) of an assembled embodiment of a wing mechanism in a hilly deployed position.
Figure 22:
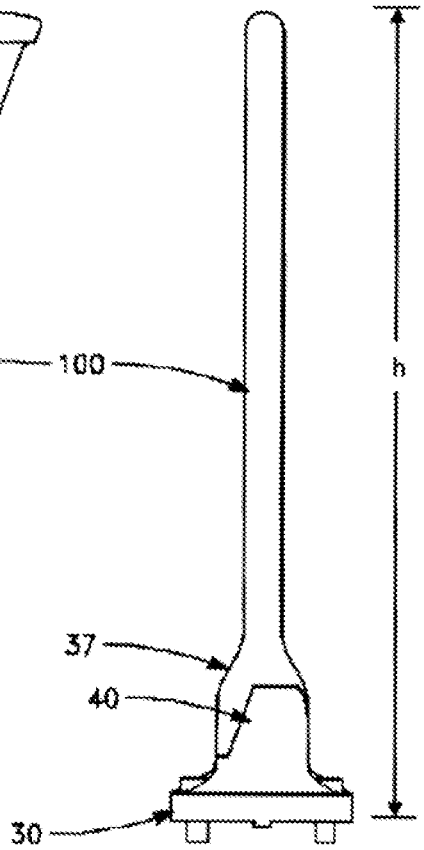
FIG. 22 is a rear view (from same side as FIG. 6) of an assembled embodiment with the wing in a fully deployed position.
Figures 23A, 23B, 23C:
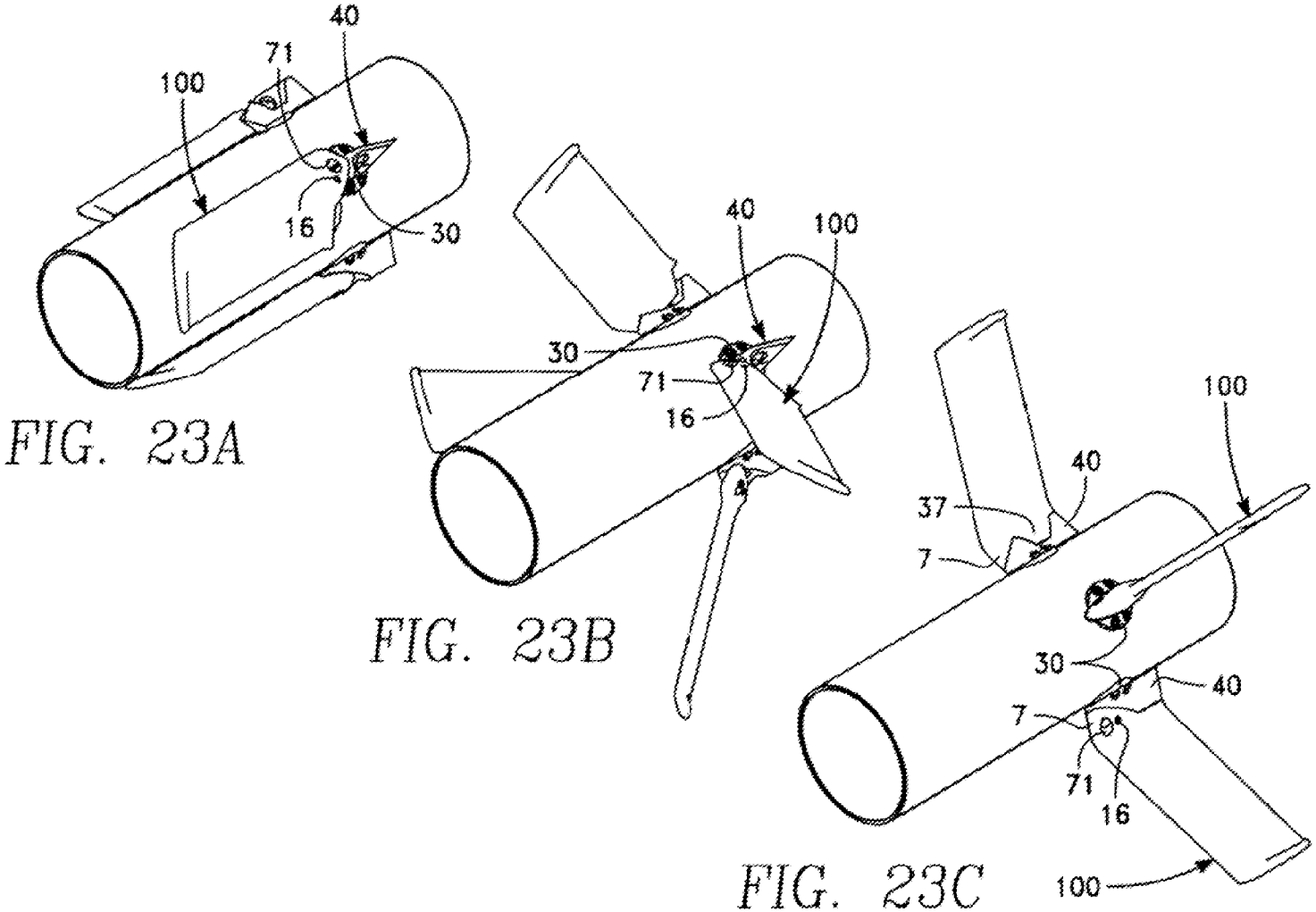
FIG. 23A is a perspective view of embodiments of wing mechanisms in a fully retracted position attached to a cylinder.
FIG. 23B is a perspective view (from same direction as FIG. 23A) of embodiments of wing mechanisms in a partially deployed position attached to a cylinder.
FIG. 23C is a perspective view (from same direction as FIG. 23A) of embodiments of wing mechanisms in a fully deployed position attached to a cylinder
Figure 24C:
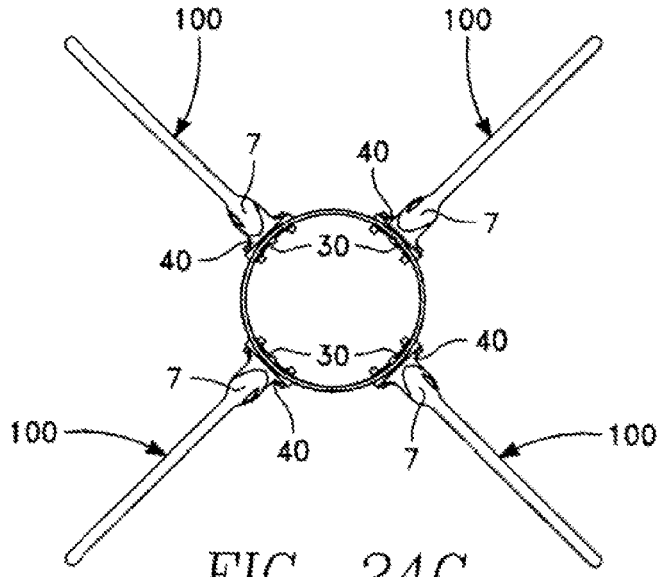
FIG. 24C is a front view (from same direction as FIG. 24A) of embodiments of wing mechanisms in a fully deployed position attached to a cylinder.
Figure 24A:
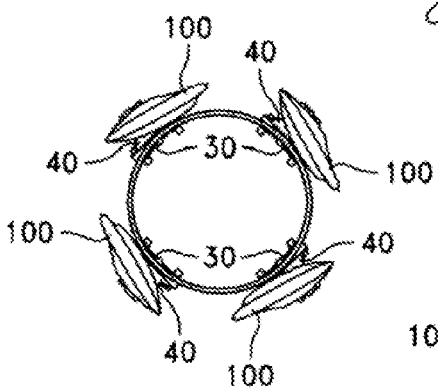
FIG. 24A is a front view of embodiments of wing mechanisms in a fully retracted position attached to a cylinder.
Figure 24B:
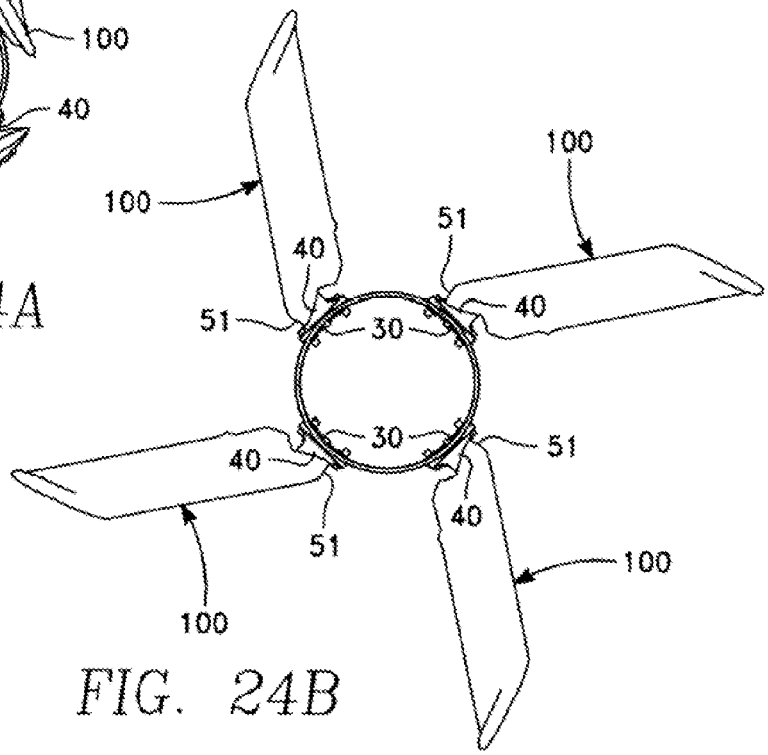
FIG. 24B is a front view (from same direction as FIG. 24A) of embodiments of wing mechanisms in a partially deployed position attached to a cylinder.
Figure 25C:
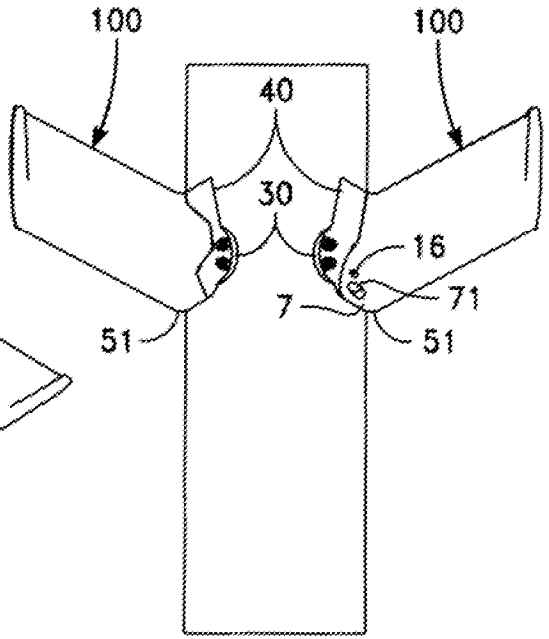
FIG. 25C is an overhead-side perspective view (from same direction as FIG. 25A) of embodiments of wing mechanisms in a fully deployed position attached to a cylinder.
Figure 25B:
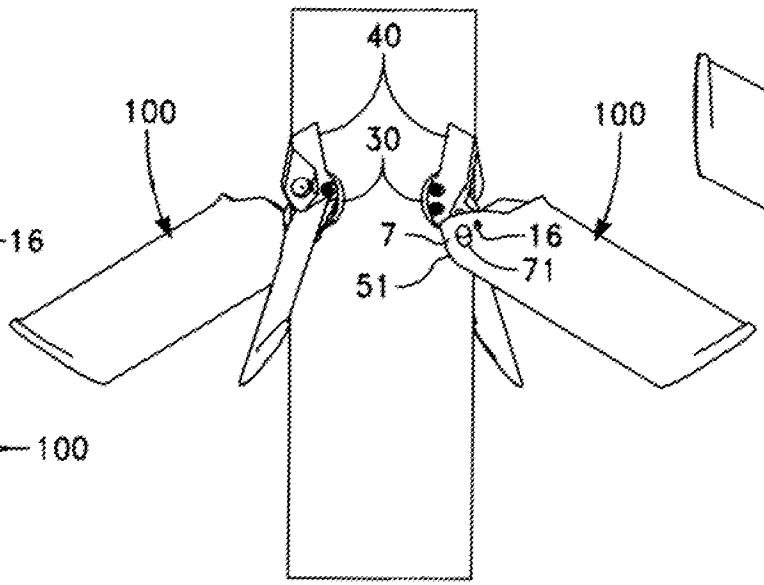
FIG. 25B is an overhead-side perspective view (from same direction as FIG. 25A) of embodiments of wing mechanisms in a partially deployed position attached to a cylinder.
Figure 25A:
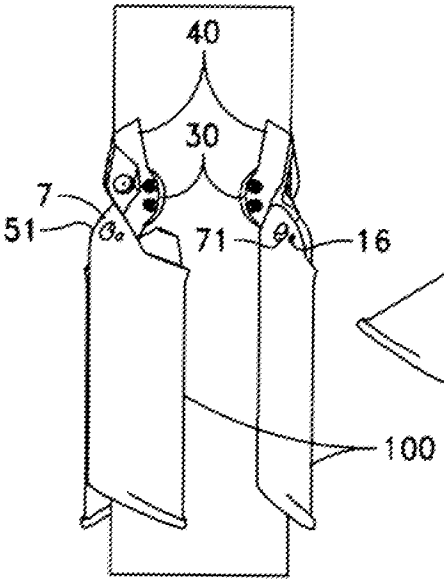
FIG. 25A is an overhead-side perspective view of embodiments of wing mechanisms in a fully retracted position attached to a cylinder.

With reference to FIGS. 21 and 22, in some embodiments, the length (l) from the bottom of mounting hub 30 to the distal tip of the wing is 3.5 inches and the length l of base 40 is about 1.5 inches. These dimension values are exemplary and can be varied according to the principles expressed herein regarding rotational axis, rearward sweep, and forward sweep. Exemplary dimensions of parts in the figures can be derived from the exemplary dimensions of length h and length l.

With reference to FIGS. 1, 2, 19A, 19B and 19C, wing 100 is affixed to base 40 by shoulder screw 1, which is oriented in line with rotational axis 157. With reference to FIGS. 1, 2, and 19B, the angle $\theta_3$ of the rotation axis 157 forward of vertical 108 (the "forward lean" angle $\theta_3$ depends upon the angle R of rearward sweep (direction designated using 159) of wing 100. More particularly, $\theta_3$=45−R/2. For example, if the rearward sweep angle R is 20 degrees, the forward lean angle $\theta_3$ of rotation axis 157 will be 35 degrees. If the rearward sweep angle R is 0 degrees, the forward lean angle $\theta_3$ of rotation axis 157 will be 45 degrees. With reference to FIGS. 1, 2, and 19C, the side-lean angle $\theta_4$ of rotation axis 157 is nominally 45 degrees, but may be modified within a typical range of 35 to 55 degrees to adjust the pose (or orientation) of wing 100 when folded.

With reference to FIGS. 19A, 19B, and 19C, $\theta_1$ is the total angle between direction 108 and rotation axis 157 and is related to $\theta_3$ and $\theta_4$ as is mathematically described in Equation 1.

$$\theta_1=\tan^{-1}\left(\sqrt{\tan^2(\theta_3)+\tan^2(\theta_4)}\right) \quad (1)$$

With reference to FIGS. 19A, 19B, and 19C, $\theta_2$ is the angle between direction 114 and the projection of rotation axis 157 onto the horizontal plane defined by directions 112 and 114, and is related to $\theta_3$ and $\theta_4$ as is mathematically described in Equation 2.

$$\theta_2 = \tan^{-1}\left(\frac{\tan(\theta_3)}{\tan(\theta_4)}\right) \quad (2)$$

Figure 8:
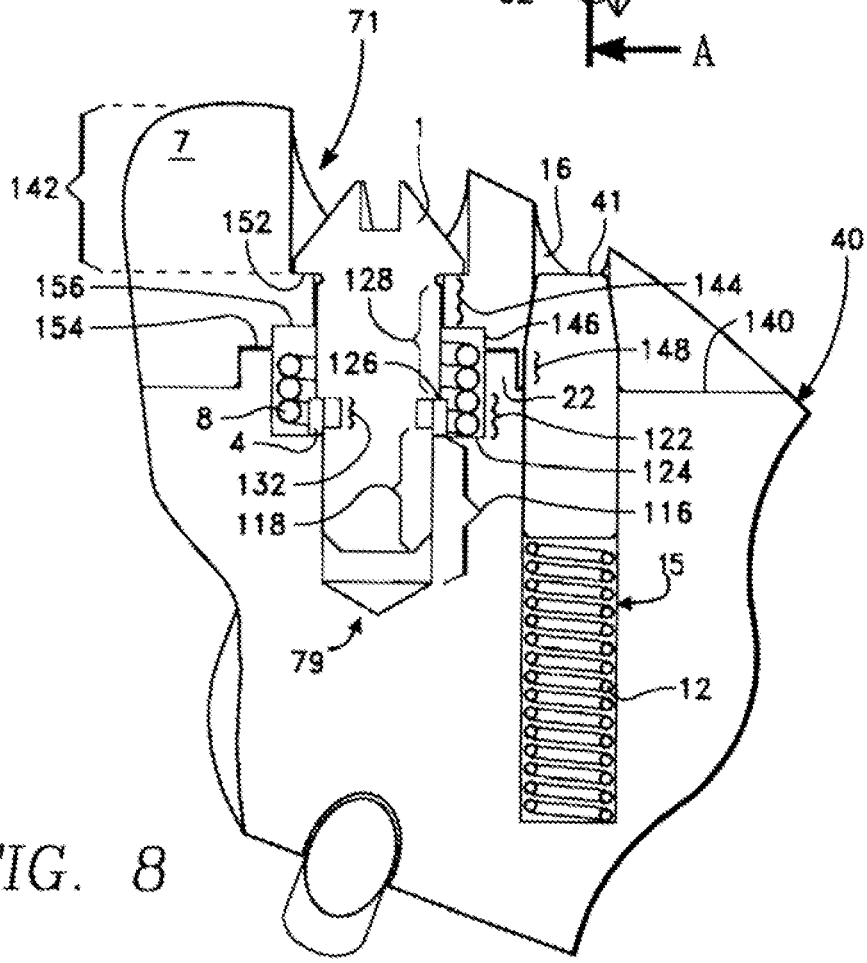
FIG. 8 is a cross-sectional view perpendicular to plane A in FIG. 7.

With reference to FIG. 8, screw 1 includes a multi-staged screw shaft, including a first stage 128 extending from the head to a thread relief section 132. A threaded stage extends from the bottom of thread relief section 132 to the bottom of the screw (along length 118). A ledge 126 is formed at the transition from the first stage 128 to the thread relief section 132.

Figures 5, 6:
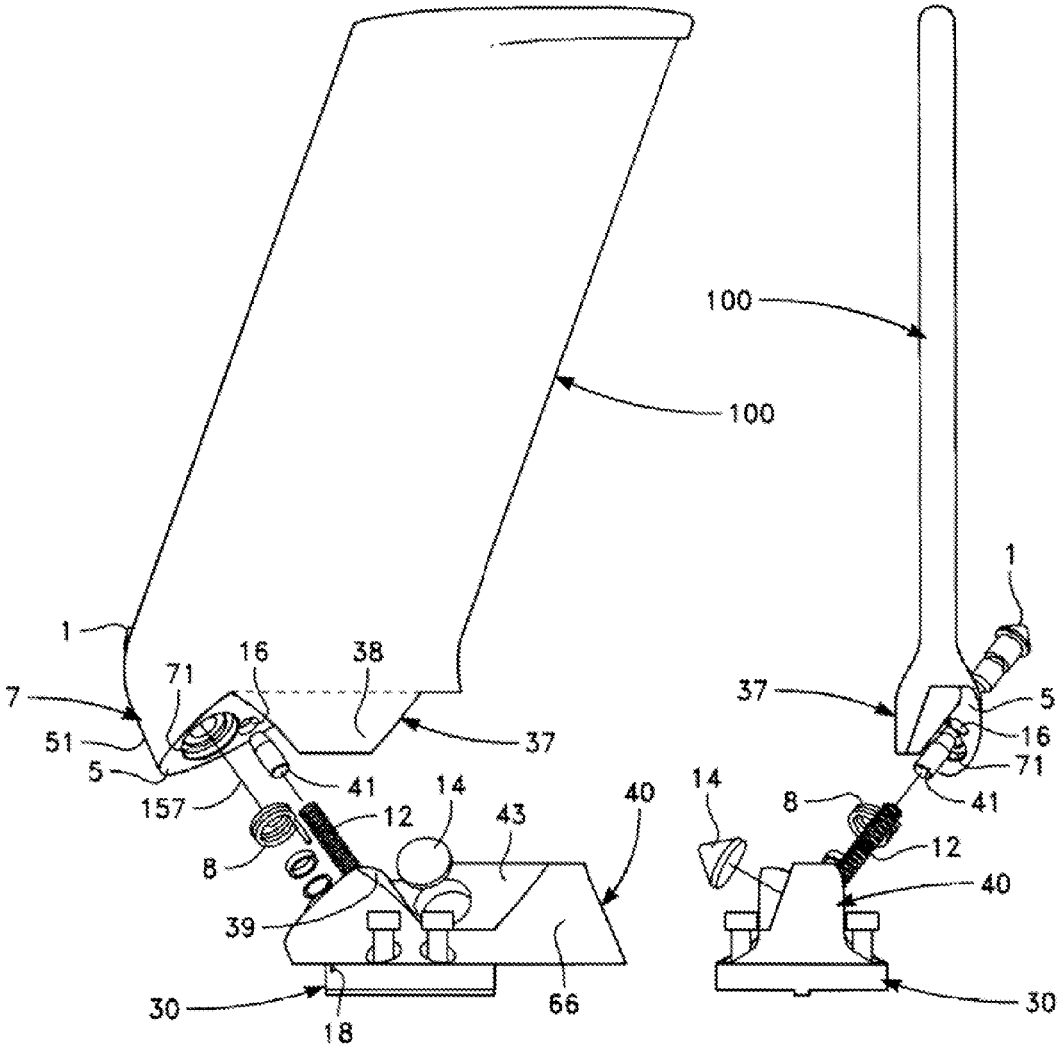
FIG. 5 is a side view (from opposite side as FIG. 1) of an unassembled embodiment of a wing mechanism in a fully deployed position.
FIG. 6 is a rear view of an unassembled embodiment of a wing mechanism.
Figure 9:
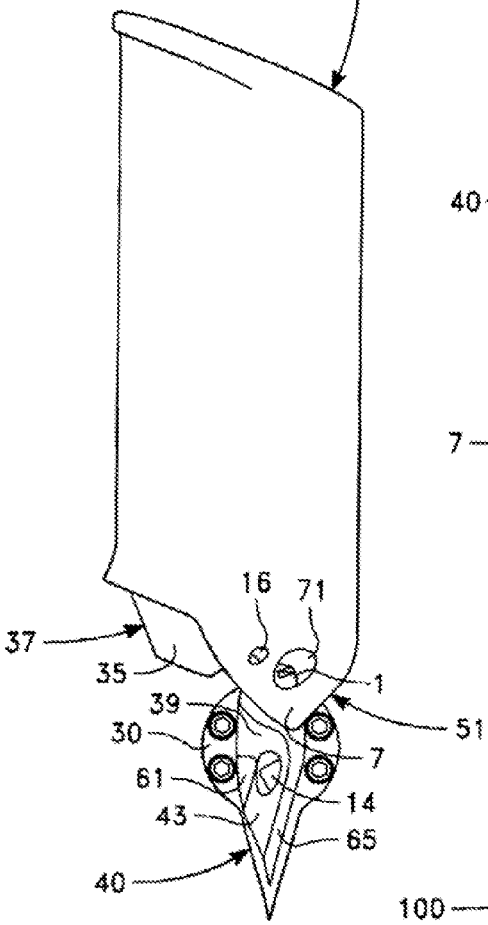
FIG. 9 is an overhead view of an assembled embodiment with the wing in a fully retracted position.
Figure 13:
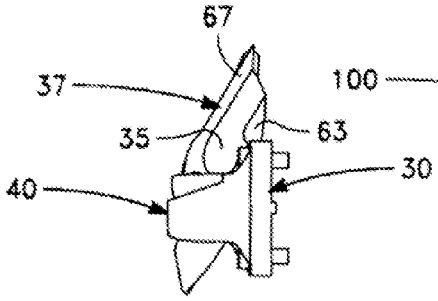
FIG. 13 is a rear view (from same side as FIG. 6) of an assembled embodiment with the wing in a fully retracted position.
Figure 12:
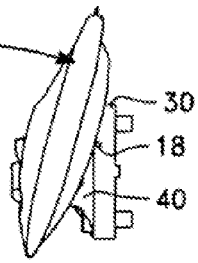
FIG. 12 is a front view (from same side as FIG. 2) of an assembled embodiment with the wing in a fully retracted position.
Figure 10:
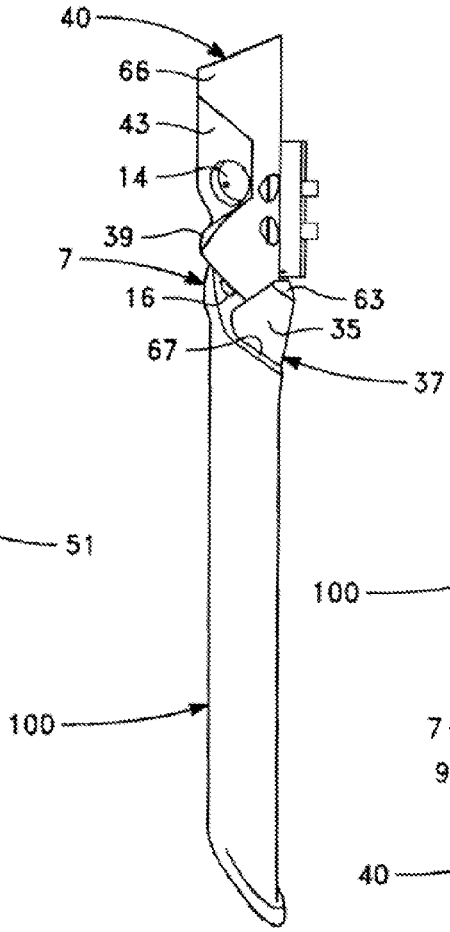
FIG. 10 is a side view (from same side as FIG. 5) of an assembled embodiment with the wing in a fully retracted position.
Figure 11:
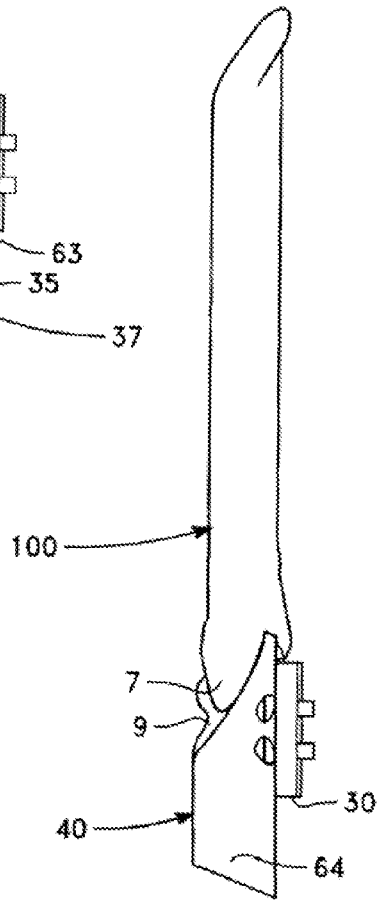
FIG. 11 is a side view (from same side as FIG. 1) of an assembled embodiment with the wing in a fully retracted position.
Figure 18:
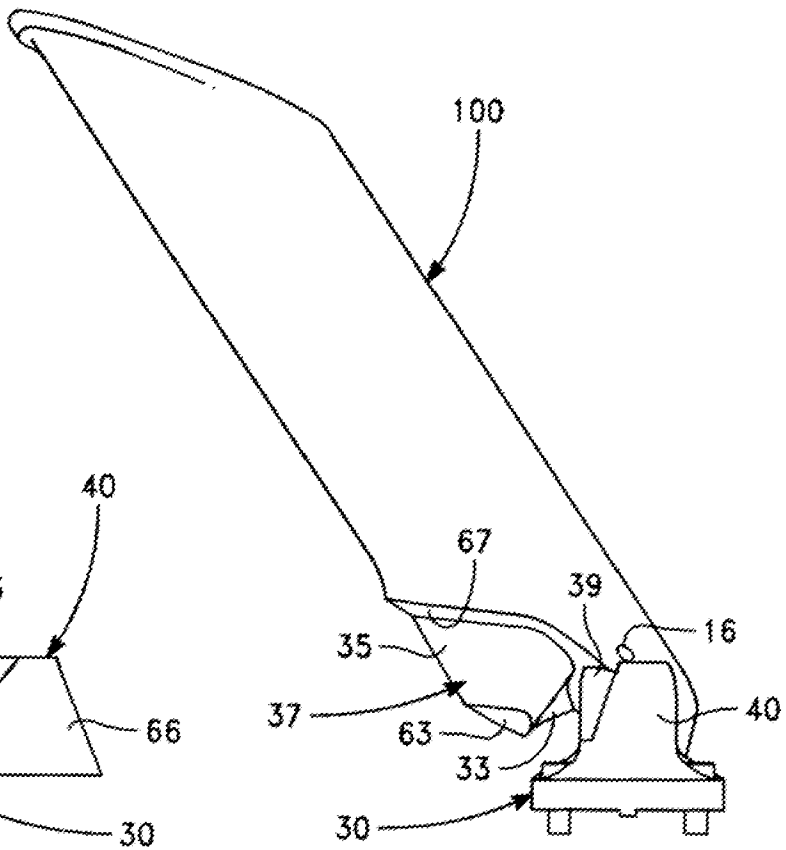
FIG. 18 is a rear view (from same side as FIG. 6) of an assembled embodiment with the wing in a partially deployed position.

With reference to FIGS. 1, 2, 7, 9, 10, and 13, wing 100 has a proximal wing root 7 and proximal tab 37. With reference to FIG. 1, wing root 7 has a forward edge 51. With reference to FIGS. 5 and 6, wing root is proximally terminated at a planar wing pivot surface 5, wherein the plane formed by planar wing pivot surface 5 is perpendicular to rotational axis 157. With reference to FIG. 19A, when wing mechanism is fully deployed, forward edge of proximal wing root 7 is in the direction indicated by 161 and has a forward sweep angle F of 15-30 degrees. With reference to FIGS. 1, 2, 9, 10 13, and 18, proximal tab 37 extends away from distal end of wing. Proximal tab 37 is formed of a curvilinear outer surface, a curvilinear inner surface, and a planar proximal surface 63. Curvilinear outer surface of tab 37 is designated using reference number 38 in FIGS. 5 and 21. With reference to FIGS. 10, 13, and 18, curvilinear inner surface of tab 37 is proximally bounded by planar proximal surface 63 and distally bounded in part by a planar surface 67 and in part by planar wing pivot surface. With reference to FIG. 18, the curvilinear inner surface is described herein as being formed of two integrally formed surfaces: 1) a partial cylinder tab-base counter-surface 33; and 2) a curvilinear tab-base counter-surface 35. Though surfaces 33 and 35 do not have a discontinuity or sharp edge between them, for the purposes of this application, the curvilinear inner surface of tab 37 is referred to as having two integrally formed surfaces 33 and 35. Note that planar surface 67 is integrally formed with wing-pivot surface.

Figure 14:
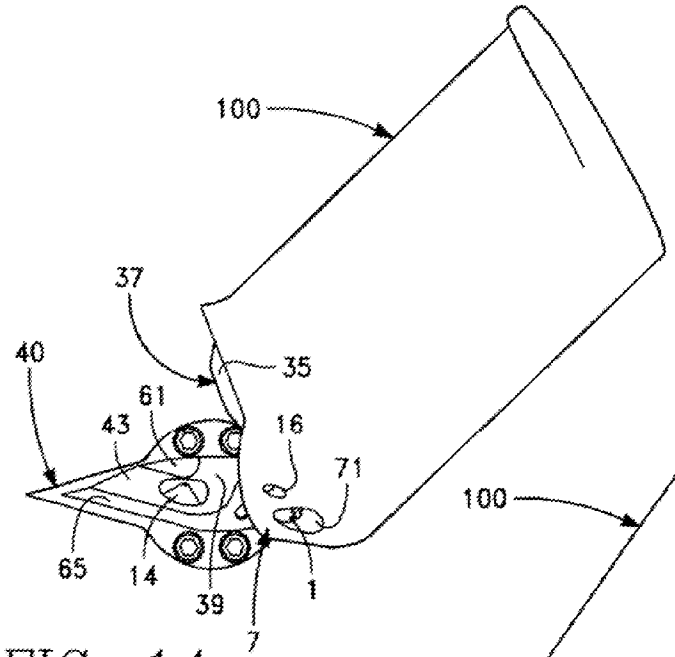
FIG. 14 is an overhead view of an assembled embodiment with the wing in a partially deployed position.
Figure 15:
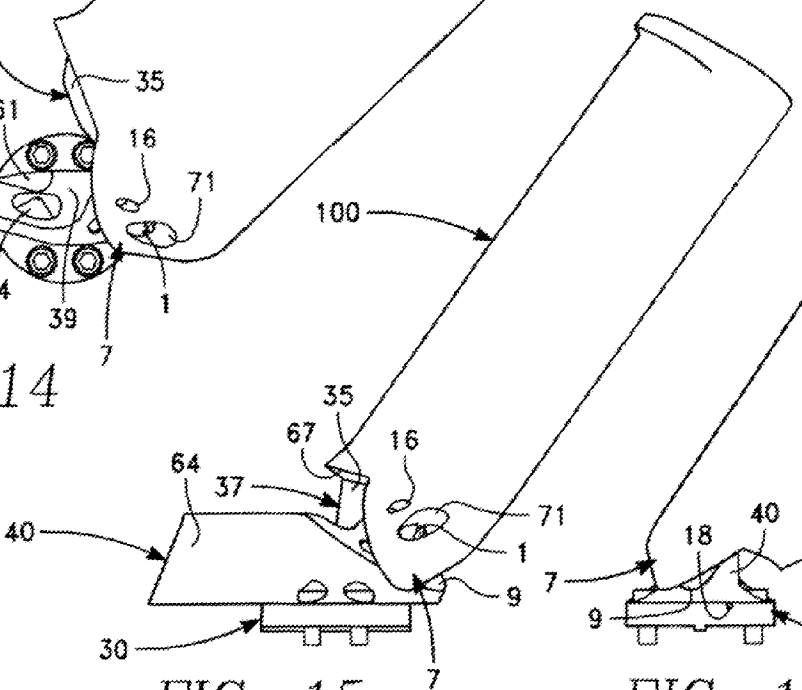
FIG. 15 is a side view (from same side as FIG. 1) of an assembled embodiment with the wing in a partially deployed position.
Figure 16:
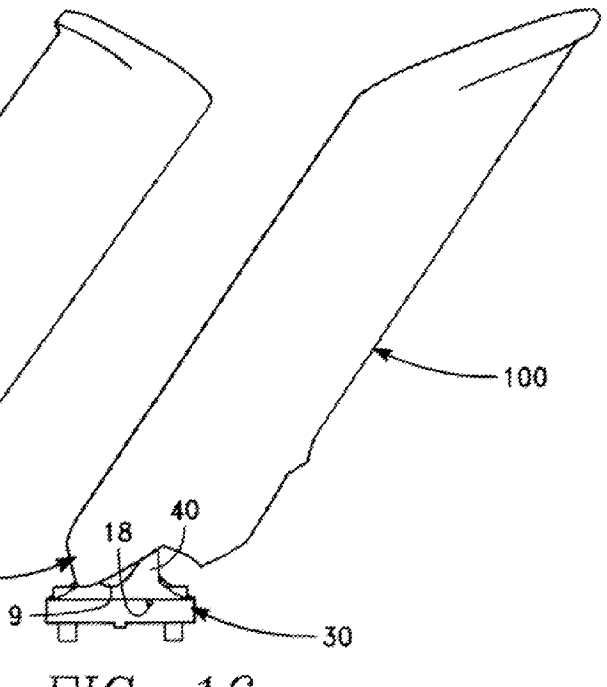
FIG. 16 is a front view (from same side as FIG. 2) of an assembled embodiment with the wing in a partially deployed position.
Figure 17:
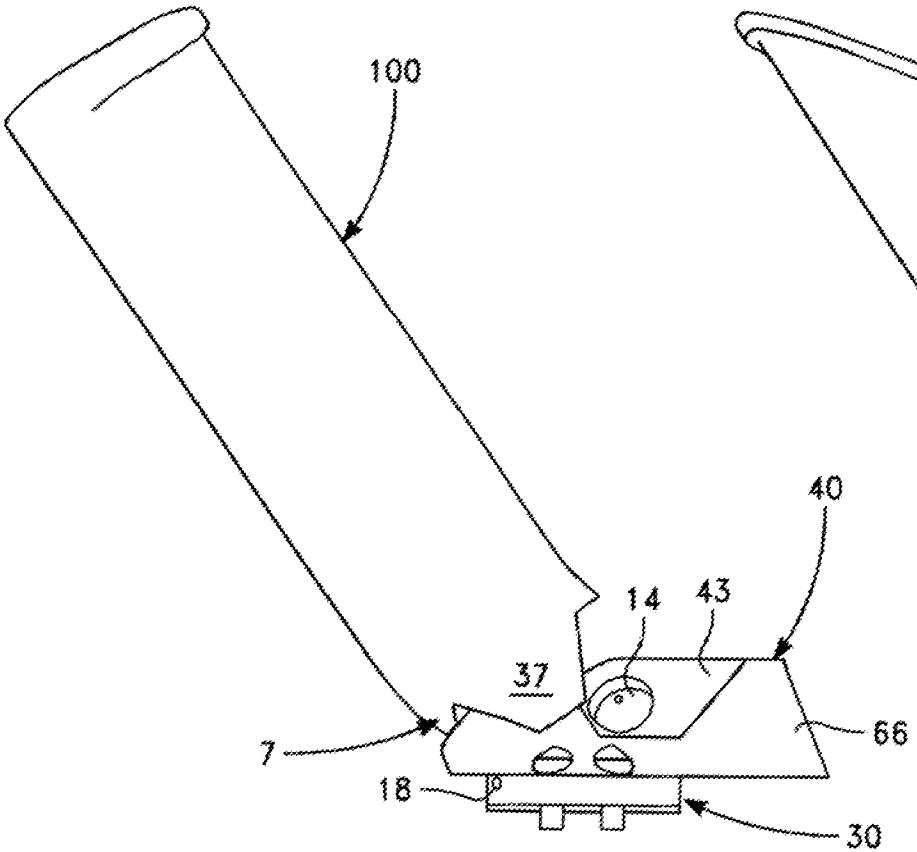
FIG. 17 is a side view (from same side as FIG. 5) of an assembled embodiment with the wing in a partially deployed position.

With reference to FIGS. 1, 5, 7, 9, and 14, base 40 is defined by planar bottom surface 62; a first curvilinear side surface 64; a second curvilinear side surface 66; planar upper surface 65 parallel to planar bottom surface 62; an oblique (neither parallel nor perpendicular to the longitudinal direction of the airframe body) planar base pivot surface 9; and a base-tab contact surface bounded by planar upper surface 65, second curvilinear side surface 66, and planar base pivot surface 9. With reference to FIGS. 9 and 14, base-tab contact surface is formed of a first portion (partial cylinder base-tab counter-surface) 39 integrally formed with a second portion (base-tab curvilinear counter-surface) 43, and a third portion (planar base-tab surface) 61 bounding the bottom ends of partial cylinder base-tab counter-surface 39 and base-tab curvilinear counter-surface 43. With reference to FIGS. 9 and 10, planar base-tab surface 61 has the same shape as planar proximal tab surface 63. Planar-tab surface 61 is parallel to planar proximal tab surface 63 when the wing is fully deployed. With reference to FIGS. 17 and 18, the surface formed by partial cylinder tab-base counter-surface 33 and curvilinear tab-base counter-surface 35 has the same shape as the surface formed by partial cylinder base-tab counter-surface 39 and base-tab curvilinear counter-surface 43, such that the surfaces mate when wing is fully deployed. With reference to FIGS. 9 and 10, planar surface 67 has the same shape as planar upper surface 65, and planar surface 67 is parallel to planar upper surface 65 when wing mechanism is fully deployed. Note that surfaces 35 and 43 are specifically oriented so that forces resulting from rotational impact between wing and base are purely perpendicular to the rotation axis such that the circular boss 22 (described below and illustrated in FIG. 8), not screw 1, is acted upon by impact forces (forces when counter-surfaces make contact with their corresponding counter-surface). Also note that: 1) surfaces 35 and 43 are machined to stop rotation of the wing at a selected angle, i.e., the angle at which point the wing is fully deployed; and 2) tab 37 is dimensioned to be able to withstand high-speed, rotational impact between wing and base without breaking (exemplary dimensions for the tab are derivable from the drawings given the exemplary dimensions of lengths h and l given above).

In some embodiments, when wing mechanism is fully deployed, wing and tab form a gap-free structure (other than apertures/holes/insets/channels described herein). In these embodiments, the gap-free external surface of the fully deployed wing mechanism is continuous, with no sharp transitions between the base and wing, and forms a symmetric, airfoil-shaped cross-section throughout the height of wing mechanism, excluding the base. In some embodiments, the cross section of the proximal portion of the wing mechanism, formed by the base, wing root, and tab, has a more pronounced side flare than the distal portion of the wing mechanism to house the internal components.

With reference to FIGS. 1 and 2, a wing mounting hole 71 is bored through proximal wing root 7 in line with rotational axis 157. With reference to FIG. 8, wing mounting hole 71 has a multi-staged radius having four stages (outer stage 142, first inner stage 144, second inner stage 146, and innermost stage 148). Radius of outer stage 142 is greater than radius of first inner stage 144. Radius of first inner stage 144 is smaller than outer radius of torsion spring 8 (where included). Note that though the embodiments illustrated in FIG. 8 include torsion spring 8, torsion spring 8 is not included in some embodiments. Radius of second inner stage 146 is larger than radius of first inner stage 144 and larger than outer radius of torsion spring 8 (where included). Ledge 152 is formed at the transition between outer stage 142 and first inner stage 144. Inner radius of ledge 152 is smaller than outer radius of the head of screw 1. The radius of outer stage 142 is larger than radius of the head of screw 1. Radius of innermost stage 148 is larger than radius of second inner stage 146 and adapted to receive boss 22 (outer radius of boss 22 is slightly less than radius of innermost stage 148) such that outer side of boss 22 snugly fits into innermost stage (thereby prohibiting non-rotational sliding between the base and wing across the base contact surface and wing contact surface when assembled). Ledge 156 is formed at the transition between first inner stage 144 and second inner stage 146. Ledge 154 is formed at the transition between second inner stage 146 and innermost stage 148.

With reference to FIG. 8, circular boss 22 protrudes from planar base pivot surface 9 and is adapted to fit within innermost stage 148 of wing mounting hole 71. Circular boss 22 is radially centered at center of base-contact-surface-pivot hole 79. Base-contact-surface-pivot hole 79 is an aperture beginning at planar base pivot surface (at 140 which indicates contact line of planar base pivot surface and wing pivot surface) and that extends a predetermined distance into base at a direction perpendicular to planar base pivot surface 9; base-contact-surf ace-pivot hole 79 has a multi-staged radius of two stages (outer stage 122 and inner stage 116), wherein a ledge 124 is formed at the transition between stages 122 and 116. Radius of inner stage 116 is smaller than radius of outer stage 122. Also, stage 116 is threaded to threadingly-mate with threads along length 118 of screw 1. Radius of outer stage 122 is adapted to be larger than the outer radius of torsion spring 8 (where included). Ledge 124 has an inner radius that is smaller than the outer radius of torsion spring 8 (where included) such that torsion spring 8 rests on ledge 124. Ledge 124 has an inner radius smaller than the outer radius of sleeve 4 (and shim(s) 6 where included as illustrated in FIG. 1), allowing sleeve 4 (and shim(s) 6 where included) to rest on ledge 124 (circumscribed by torsion spring 8). Sleeve 4 (and shim(s) 6 where included) are formed of a rigid material that resists compressive forces, such as, for example, metallic material. The outer radius of ledge 126 is a length between inner and outer radius of sleeve 4 (and shim(s) 6 where included), such that when assembled, sleeve 4 contacts ledge 126; contact between ledge 126 and sleeve 4 (and shim(s) 6 where included) prevents further screwing in of screw 1 and thereby can provide the proper spacing between the base and fastener 1 necessary to sufficiently fix wing to base while allowing rotation necessary for deployment of wing. With reference to FIG. 1, spring 8 (where included).is assembled between wing pivot surface 5 and base pivot surface 9 and assists with wing deployment by applying rotational torque to wing 100. Note that embodiments illustrated in FIG. 1 include a sleeve 4 and shim(s) 6. However, a custom-made screw would allow avoiding use of sleeve 4 and shim(s) 6 by placing ledge 126 at a location to create the proper separation. A person having ordinary skill in the art will appreciate that sleeve 4 and shim(s) 6 would not be required in some embodiments.

With reference to FIGS. 1 and 5, base 40 includes a locking pinhole (pin cavity) 15 through planar base pivot surface 9 extending into base 40 at a direction perpendicular to plane of base pivot surface 9; locking pinhole (pin cavity) 15 houses compression spring 12 and tapered locking pin 41. Locking pinhole (pin cavity) 15 extends an amount into base 40 greater than the sum of the length of compressed compression spring 12 and the length of tapered locking pin 41. While in a non-fully extended position, wing pivot surface covers locking pinhole (pin cavity) 15, thereby keeping locking pin 41 from protruding past plane formed by base pivot surface 9. When wing is fully deployed, locking pinhole (pin cavity) 15 aligns with tapered hole 16, thereby uncovering tapered locking pin 41, allowing tapered locking pin 41 to be partially pushed across the precipice defined by plane of planar base pivot surface 9 and wing pivot surface 5 into tapered hole 16 by compression spring 12 an amount that causes a portion of locking pin to extend into tapered hole 16 and a portion of locking pin to remain in locking pinhole (pin cavity) 15 supported by compression spring 12. Tapered hole 16 is tapered to have a smaller distal radius than the radius of tapered locking pin 41 so that tapered locking pin 41 is not pushed entirely across the precipice 140. Wing can be manually unlocked by depressing tapered locking pin 41 into locking pinhole (pin cavity) 15 using an external object such that locking pin no longer traverses plane formed by planar base pivot surface 9.

Figure 7:
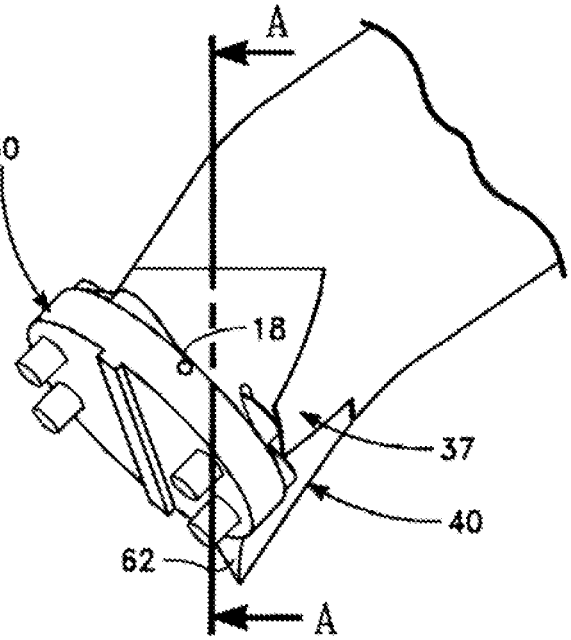
FIG. 7 is a perspective view of a proximal end of a wing, an embodiment of a base, and an embodiment of a mounting hub, wherein the wing is in a fully deployed position.

With reference to FIGS. 2 and 7, air inlet hole 18 is bored through forward side of mounting hub 30 and provides a channel that intersects locking pin-hole 15, which prevents a vacuum when tapered locking pin 41 is rapidly deployed into tapered hole 16.

With reference to FIG. 5, some embodiments include an inset bumper 14 attached to an inset on base-tab curvilinear counter-surface 43; where included, inset bumper 14 absorbs energy of the wing impacting the base when deployed by making contact with curvilinear tab-base counter-surface 35. Inset bumper 14 is formed of a deformable, elastic material such as urethane rubber or a crushable, energy-absorbing material such as aluminum foam, which may have better performance and durability over a larger range of temperature and environmental conditions.

The Folded Position of the Articulated Wing Mechanism

FIGS. 9-13, 23A, 24A, and 25A illustrate various views of embodiments in a fully retracted or folded position. In the folded position the tapered locking pin 41 and compression spring 12 are confined within pin cavity 15 of base 40 by, wing pivot surface 5 and pin cavity 15 is not in alignment with tapered hole 16. Further, the mechanism is oriented with the wingtip toward the nose., or direction of travel of the vehicle, and the wing root 7 is positioned aft of the wingtip.

The Extended and Locked Position of the Articulated Wing Mechanism

FIGS. 3-4, 20-22, 23C, 24C, and 25C illustrate various views of embodiments in a fully deployed position. With reference to FIGS. 1, 5, 14, 17, and 18, wing mechanism is in its fully extended and locked position when: 1) all of planar base pivot surface 9 is in touching contact with all of wing pivot surface 5; 2) all of base-tab curvilinear counter-surface 43 is in touching contact with all of complimentary curvilinear tab-base counter-surface 35; 3) all of partial cylinder tab-base counter-surface 33 is in close proximity to all of complementary partial cylinder base-tab counter-surface 39, thereby forming two adjacent concentric partial cylinders; 4) all of proximal planar surface 63 is in close proximity to all of planar base-tab surface 61; and 5) all of planar upper surface 65 is in close proximity to all of planar surface 67. Contact between base-tab curvilinear counter-surface 43 with complementary curvilinear tab-base counter-surface 35 stops rotation of the wing in the deploying rotation direction. In the deployed state, the tapered locking pin 41 partially extends into tapered hole 16 as pin cavity is in co-axial alignment with tapered hole 16, thereby locking wing in a fully extended position. Note that a person having ordinary skill in the art will appreciate that the pairs of surfaces listed in conditions 3, 4, and 5 would ideally be in touching contact to form a gap-free structure, but that separation will typically exist as a product of machining using minimal clearances (based on machine tolerances) to ensure that the surfaces in conditions 3, 4, and 5 do not make contact that would prevent counter-surfaces 43 and 35 from making contact to stop rotation. Two surfaces are in "close proximity" if their separation is within machine tolerances applied to ensure that the surfaces do not prevent counter-surfaces 43 and 35 from making contact that would stop rotation.

Operation of the Wing Mechanism.

The folding and locking articulated wing mechanism preferably is operated by application of acceleration forces of vehicle launch and/or by resulting aerodynamic forces on the vehicle and ring mechanism occurring during initial flight. During rapid acceleration directed along the longitudinal axis of the vehicle, inertial forces act on the folded wing subassembly which cause the wing subassembly to rotate about fastener 1 until the rotation is arrested by contact between base-tab curvilinear counter-surface 43 and complementary curvilinear tab-base counter-surface 35. Where included, torsion spring 8 assists in deployment of the wing subassembly. Where included, the torsion spring 8 can be configured such that it assists in the opening of the wing through the first portion of the rotation and assists in slowing the wing in the last portion of the rotation. This may be accomplished by adjusting the neutral angle of the torsion spring 8 through the proper placement of the torsion spring leg holes. Planar base pivot surface 9 and planar wing pivot surface 5 slidingly engage while remaining parallel (to each other) throughout the complete rotation.

Alternatively, the wing may be moved between the folded position and the fully extended and locked position manually or by any conventional device adapted to do so.

Vehicle flight control system actuators connected with base 40 can rotate the wing about its vertical axis to provide the vehicle directional flight control authority.

While the invention has been described in connection with what are presently considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A folding wing mechanism, comprising:

a base having a rear end, a forward end, a first side and a second side; wherein said base is defined by a planar bottom surface; a first curvilinear side surface; a second curvilinear side surface; a planar upper surface parallel to said planar bottom surface; an oblique planar base pivot surface; and a base-tab contact surface defining a surface bounded by said planar upper surface, said second curvilinear side surface, and said planar base pivot surface;

wherein said base-tab contact surface is formed of a first portion referred to as a partial cylinder base-tab counter-surface integrally formed with a second portion referred to as a base-tab curvilinear counter-surface, and a third portion referred to as a planar base-tab surface bounding the bottom ends of said partial cylinder base-tab counter-surface and said base-tab curvilinear counter-surface; wherein said planar base-tab surface is parallel to said planar bottom surface; a wing having a proximal wing root and a proximal tab;

wherein a vertical direction is defined as a direction perpendicular to the plane formed by said planar bottom surface from said planar bottom surface toward said wing;

wherein a forward direction is defined as a direction from said rear end to said forward end;

wherein a side direction is defined as a direction from said second side to said first side;

an axis of rotation about which said wing rotates when deploying, wherein said axis of rotation forms a forward lean angle $\theta_3$ from said vertical direction toward said forward direction; wherein said axis of rotation forms a side lean angle $\theta_4$ from said vertical direction toward said side direction;

wherein said wing root is proximally terminated by a planar wing pivot surface; wherein the plane formed by said planar wing pivot surface is perpendicular to said axis of rotation, and parallel to said planar base pivot surface, when said wing mechanism is assembled;

wherein said proximal tab is proximally terminated by a planar proximal surface; wherein an inner surface of said proximal tab is formed of two integrally formed surfaces referred to as a partial cylinder tab-base counter-surface and a curvilinear tab-base counter-surface that are proximally bounded by said planar proximal surface, wherein said planar proximal surface has the same shape as said planar base-tab surface; wherein the surface formed by said partial cylinder base-tab counter-surface and said base-tab curvilinear counter-surface is distally bounded in part by a planar surface and in part by said planar wing pivot surface;

a fastener;

a wing mounting hole through said wing root adapted to receive said fastener, wherein said wing mounting hole is in line with, and centered at, said axis of rotation;

a base mounting hole in said base through said planar base pivot surface, wherein said base mounting hole is in line with, and centered at, said axis or rotation;

wherein said fastener axially fastens said wing to said base when assembled;

wherein said planar base pivot surface and said planar wing pivot surface slidingly engage while remaining parallel to each other throughout the complete rotation of said wing mechanism from a fully retracted position to a fully deployed position, wherein said wing rotates from said retracted position to said fully deployed position about said rotation axis;

wherein wing mechanism is in its fully extended position when: 1) all of planar base pivot surface is in touching contact with all of planar wing pivot surface; 2) all of base-tab curvilinear counter-surface is in touching contact with all of complimentary tab-base curvilinear counter-surface; and 3) all of partial cylinder tab-base counter-surface is in close proximity to all of complementary partial cylinder base-tab counter-surface, thereby forming two adjacent concentric partial cylinders; 4) all of said proximal planar surface is in close proximity to all of said planar base-tab surface; and 5) all of said planar upper surface is in close proximity to all of said planar surface and wherein, when fully deployed, the wing mechanism forms an external surface with no sharp transitions between the base and wing, wherein said external surface has a symmetric, airfoil-shaped cross-section throughout the height of said wing mechanism.

2. The wing mechanism of claim 1, further comprising:

a tapered locking pin;

a compression spring a pin cavity in said base through said planar base pivot surface perpendicular to said planar base pivot surface; wherein said pin cavity is adapted to receive said tapered locking pin and is deep enough to contain the entire length of said tapered locking pin plus the length of said compression spring when compressed;

a tapered hole in said wing root through said planar wing pivot surface; wherein said tapered hole is complimentarily tapered to a taper of said tapered locking pin; and wherein when said wing mechanism is fully deployed, said pin cavity and said tapered hole are in co-axial alignment allowing compression spring to urge said tapered locking pin to lie partially across the precipice of a contact plane of said planar base pivot surface and said planar wing pivot surface.

3. The wing mechanism of claim 2, further comprising a circular boss that protrudes from planar base pivot surface and is dimensioned to fit into said wing mounting hole; wherein said circular boss prohibits non-rotational sliding between said planar wing contact surface and said planar base pivot surface during deployment of said wing from said retracted position to said fully deployed position.

4. The wing mechanism of claim 3, further comprising a torsion spring disposed across said planar wing contact surface and said planar base pivot surface within a cavity formed by said wing mounting hole and said base mounting hole, with a first end of said torsion spring removably affixed to an inside of said wing mounting hole and a second end of said torsion spring removably affixed to an inside of said base mounting hole.

5. The wing mechanism of claim 3, wherein said wing has a rearward sweep from a proximal end of said wing root to a distal end of said wing, wherein said rearward sweep forms an angle of R degrees from said vertical direction to a backward direction, wherein said backward direction is the direction from said forward end to said rear end, wherein said forward lean angle $\theta_3$ is equal to 45−R/2.

6. The wing mechanism of claim 5, wherein said forward sweep forms an angle of F degrees from said vertical direction to said forward direction when said wing is fully deployed, wherein F is between 15 and 30 degrees.

7. The wing mechanism of claim 6, wherein said side lean angle $\theta_4$ is 45 degrees.

8. The wing mechanism of claim 7, wherein a height of said wing mechanism is 3.5 inches.

9. The wing mechanism of claim 8, wherein a length of said base is 1.5 inches.

10. The wing mechanism of claim 9, wherein said boss protrudes 0.040 inches from said planar base pivot surface.

* * * * *